US007473141B2

(12) United States Patent
Liao

(10) Patent No.: US 7,473,141 B2
(45) Date of Patent: Jan. 6, 2009

(54) TRANSFER PLUG FOR A VARIETY OF SOCKETS

(76) Inventor: Sheng-Hsin Liao, No. 10, Alley 38, Lane 229, San Chun St., Shulin City, Taipei Hsien (TW)

( * ) Notice: Subject to any disclaimer, the term of this patent is extended or adjusted under 35 U.S.C. 154(b) by 0 days.

(21) Appl. No.: 11/706,268

(22) Filed: Feb. 15, 2007

(65) Prior Publication Data

US 2008/0050975 A1 Feb. 28, 2008

(30) Foreign Application Priority Data

Aug. 25, 2006 (TW) ..... 95131519

(51) Int. Cl.
*H01R 25/00* (2006.01)

(52) U.S. Cl. ..... 439/638; 439/640

(58) Field of Classification Search ..... 439/638, 439/640, 660, 172, 171
See application file for complete search history.

(56) References Cited

U.S. PATENT DOCUMENTS

| | | | | |
|---|---|---|---|---|
| 3,025,486 | A * | 3/1962 | Falconer | 439/103 |
| 4,959,021 | A * | 9/1990 | Byrne | 439/310 |
| 4,997,381 | A * | 3/1991 | Oh | 439/172 |
| 5,681,171 | A * | 10/1997 | Park | 439/31 |
| 6,126,460 | A * | 10/2000 | Wu | 439/131 |
| 6,142,834 | A * | 11/2000 | Liao | 439/676 |
| 6,210,231 | B1 * | 4/2001 | Lai | 439/610 |
| 6,213,782 | B1 * | 4/2001 | Derstine | 439/31 |
| 6,358,088 | B1 * | 3/2002 | Nishio et al. | 439/596 |
| 6,382,996 | B1 * | 5/2002 | Eyman | 439/172 |
| 6,402,546 | B1 * | 6/2002 | Groves et al. | 439/501 |
| 6,464,519 | B1 * | 10/2002 | Hawks | 439/172 |
| 6,786,734 | B2 * | 9/2004 | Yu | 439/11 |
| 6,915,562 | B2 * | 7/2005 | Joist et al. | 29/758 |
| 6,923,666 | B1 * | 8/2005 | Liao | 439/172 |
| 7,001,192 | B1 * | 2/2006 | Yeh | 439/131 |

(Continued)

FOREIGN PATENT DOCUMENTS

| | | |
|---|---|---|
| TW | M292800 | 6/2006 |

OTHER PUBLICATIONS

U.S. Appl. No. 11/409,977 to Liao ("A Mobile Transforming Plug") filed Apr. 25, 2006.

*Primary Examiner*—T C Patel
*Assistant Examiner*—Vladimir Imas
(74) *Attorney, Agent, or Firm*—McGinn IP Law Group, PLLC

(57) ABSTRACT

A transfer plug for a variety of sockets includes an insulating shell, a first and a second connectors and a signal plug. The insulating shell has two side arms and a first pivoted portion. The first and the second connectors correspondingly combine with the insulating shell respectively and are electrically connected. The signal plug movably connects to the insulating shell and has a third connector connecting to the second connector. The signal plug has a gliding groove in a lateral edge thereof. The insulating shell combines with the first and second connector to form a transiting plug. The signal plug can slidably move and turn in different directions in an unused state. The signal plug can be used alone and doesn't need to be disassembled. The transiting plug can be repeatedly connected to other transiting plugs and converted into a multi-tasking transfer plug with different specifications and types of sockets.

17 Claims, 9 Drawing Sheets

U.S. PATENT DOCUMENTS 7,035,126 B1 * 4/2006 Lanni ..... 363/142
7,121,850 B2 * 10/2006 Yeh ..... 439/131
7,125,265 B2 * 10/2006 Weng ..... 439/131
7,179,099 B2 * 2/2007 Hsieh ..... 439/131
7,255,567 B1 * 8/2007 Liao ..... 439/11
2005/0059301 A1 * 3/2005 Chou et al. ..... 439/660
2006/0073717 A1 * 4/2006 Ng et al. ..... 439/131

* cited by examiner

TRANSFER PLUG FOR A VARIETY OF SOCKETS

BACKGROUND OF THE INVENTION

1. Field of the Invention

The present invention relates to a transfer plug for a variety of sockets, and more especially to a transfer plug having a transiting plug and a signal plug movably connected with the transiting plug. The transiting plug can be repeatedly connected with other transiting plugs for engaging with different specifications and types of sockets.

2. Description of the Prior Art

Generally, a signal line of the prior art is electrically connected to an electrical device via an electrical connection between a signal plug combined with an end of the signal line and a corresponding socket of the electrical device. However, if the specification and type of the signal line is different from that of the socket, it is necessary to firstly connect the signal line to a transiting plug and then connect the transiting plug to the socket, thereby achieving the electrical connection between the signal line and the socket.

The connection mode between the transiting plug and the signal plug is usually a stationary connection mode. The transiting plug usually needs to be disassembled to an unused state and reassembled when required. This makes it difficult for a user to actually use the transiting plug and the signal plug. One prior art entitled "Active Transfer Plug", which discloses a transfer plug, has the above shortcomings and is difficult to use.

Hence, the inventors of the present invention believe that the shortcomings described above are able to be improved upon and suggest the present invention which is of a reasonable design as an effective improvement based on extensive research and thought.

SUMMARY OF THE INVENTION

An object of the present invention is to provide a transfer plug for a variety of sockets, of which a signal plug may slidably move and turn in different directions in an unused state. Thereby the signal plug may be used by itself and does not need to be disassembled, which is convenient for actual use.

Another object of the present invention is to provide a transfer plug for a variety of sockets, of which a first and a second connector is mounted on to an insulating shell to form a transiting plug which may be repeatedly connected with other transiting plugs to be converted into a multitasking transfer plug with different specifications and types of sockets. Thereby all options for meeting actual demand are provided.

To achieve the above-mentioned object, a transfer plug for a variety of sockets in accordance with the present invention is disclosed. The transfer plug for a variety of sockets includes an insulating shell having two side arms and a first pivoted portion; a first connector and a second connector correspondingly combining with the insulating shell respectively, the first connector and the second connector electrically connect to each other; a signal plug, movably connecting to the insulating shell, having a third connector at a front end thereof, the third connector engages with the second connector, and has a gliding groove on a lateral edge thereof, corresponding to the first pivoted portion; the insulating shell further has a sliding groove concavely on a lateral edge thereof.

To further understand the technical contents, methods and efficacy of the present invention, please refer to the following detailed description and drawings related the present invention. It is believed that the objects, features and points of the present invention can be deeply understood. However, the drawings are only to be used as references and explanations, not to limit the present invention.

DETAILED DESCRIPTION OF THE INVENTION

Figure 1:
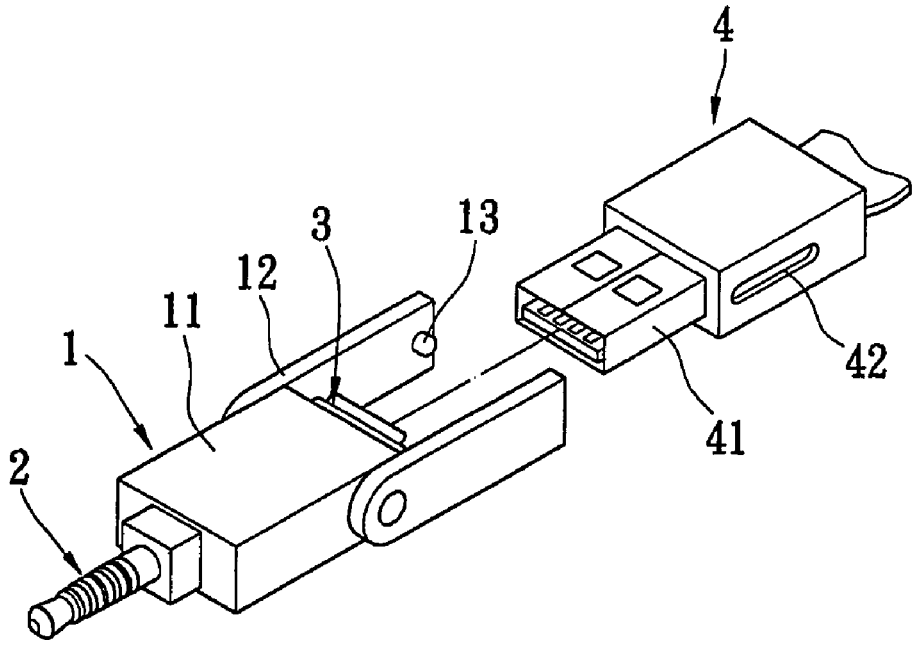
FIG. 1 is a first exploded perspective view of a transfer plug for a variety of sockets in accordance with the present invention.
Figure 2:
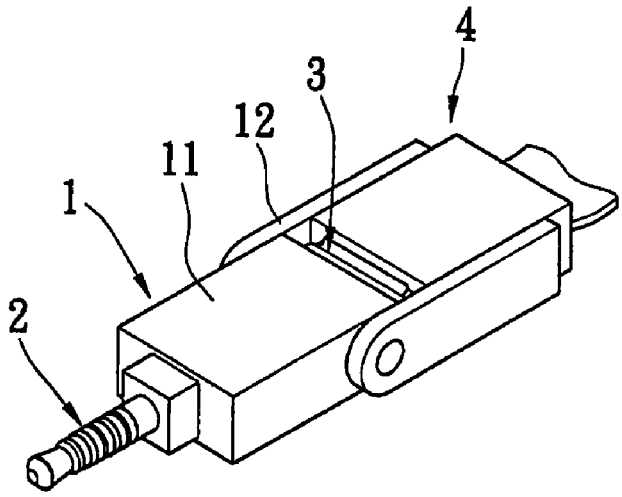
FIG. 2 is an assembled perspective view of the transfer plug for a variety of sockets in accordance with the present invention.

Please refer to FIGS. 1-6. A transfer plug for a variety of sockets in accordance with a preferred embodiment of the present invention is shown. The transfer plug includes an insulating shell 1, a first connector 2, and a second connector 3.

The insulating shell 1 is made of an insulation material, such as plastic. The insulating shell 1 includes a body portion 11 and two side arms 12 connecting with the body portion 11, respectively. Each side arm 12 has a first pivoted portion 13 formed on an inner lateral surface. The first pivoted portion 13 is a protruding pole. Furthermore, the two side arms 12 is fixed, i.e. integrally formed by means of the body portion 11 extending to form the two side arms 12 respectively. Alternatively, the two side arms 12 is rotatably combined with lateral edges of the body portion 11 via a pivoting connection and the like, respectively, so that the two side arms 12 can rotate.

The first connector 2 is combined with the body portion 11 of the insulating shell 1 on a front end of the body portion 11. The second connector 3 is combined with the body portion 11 and is disposed in the body portion 11, corresponding to the first connector 2. The first and the second connectors 2, 3 electrically connect to each other via a variety of electrical devices, such as circuit boards or terminals (not shown), which are disposed between the first connector 2 and the second connector 3. The first connector 2 can be a USB, a Mini USB, a DC plug, an audio terminal, a video terminal, a IEEE1394, a HDMI (High-Definition Multimedia Interface), or a connector for a handheld electronic product (such as a mobile phone or a PDA, etc.). Accordingly, the insulating shell 1 of the present invention combines with the first connector 2 and the second connector 3 to form a transiting plug.

Figure 3:
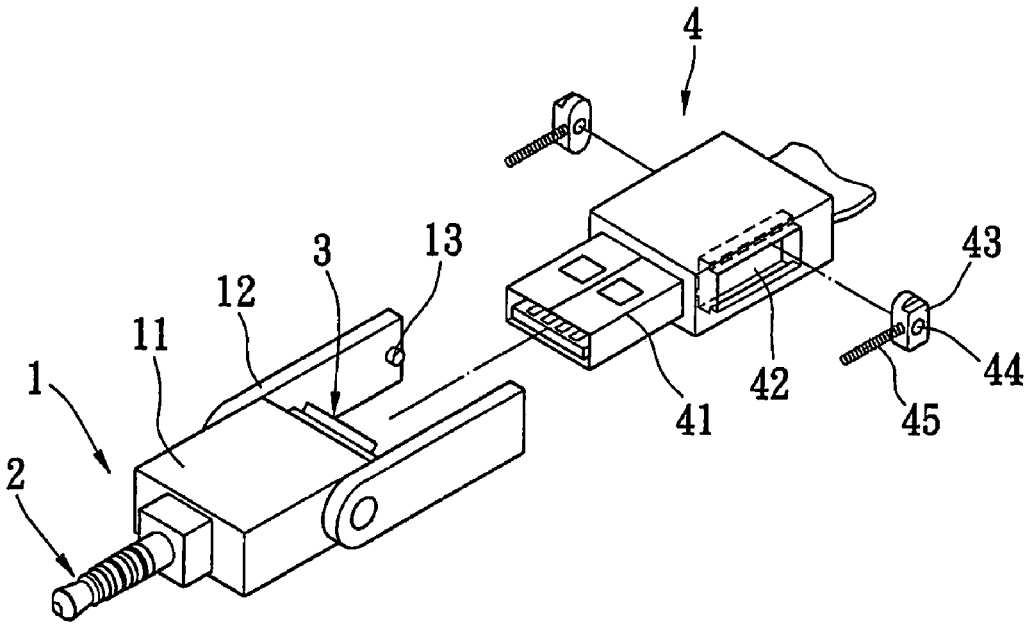
FIG. 3 is an exploded perspective view of a signal plug with gliding blocks and elastic components of the transfer plug for a variety of sockets in accordance with the present invention.
Figure 4:
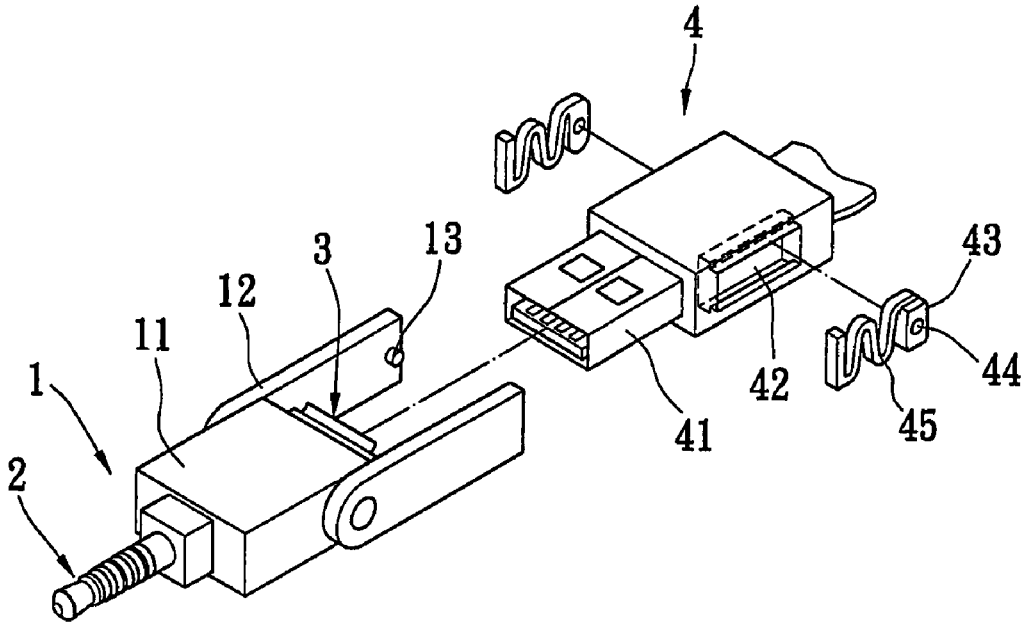
FIG. 4 is another exploded perspective view of the signal plug with the gliding blocks and the elastic components of the transfer plug for a variety of sockets in accordance with the present invention.
Figure 5:
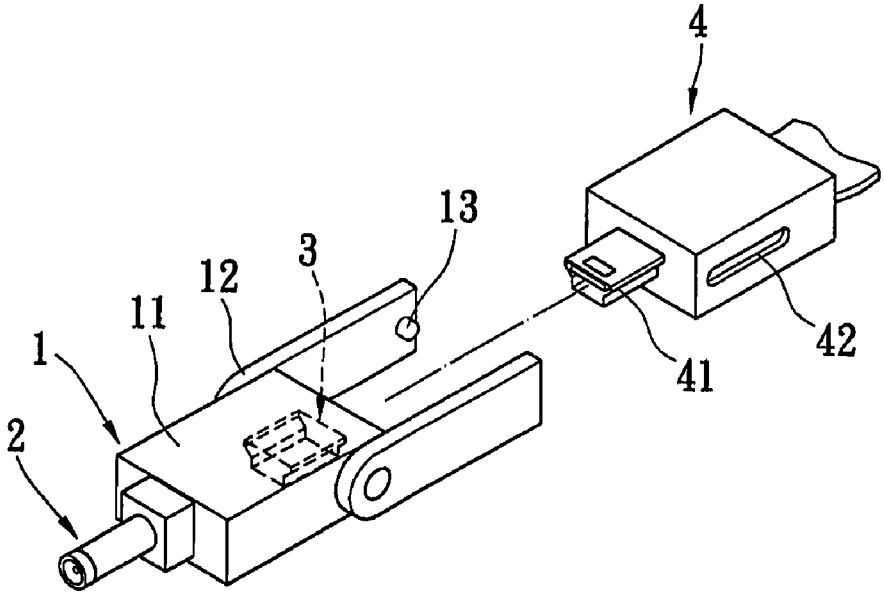
FIG. 5 is a second exploded perspective view of the transfer plug for a variety of sockets in accordance with the present invention.
Figure 6:
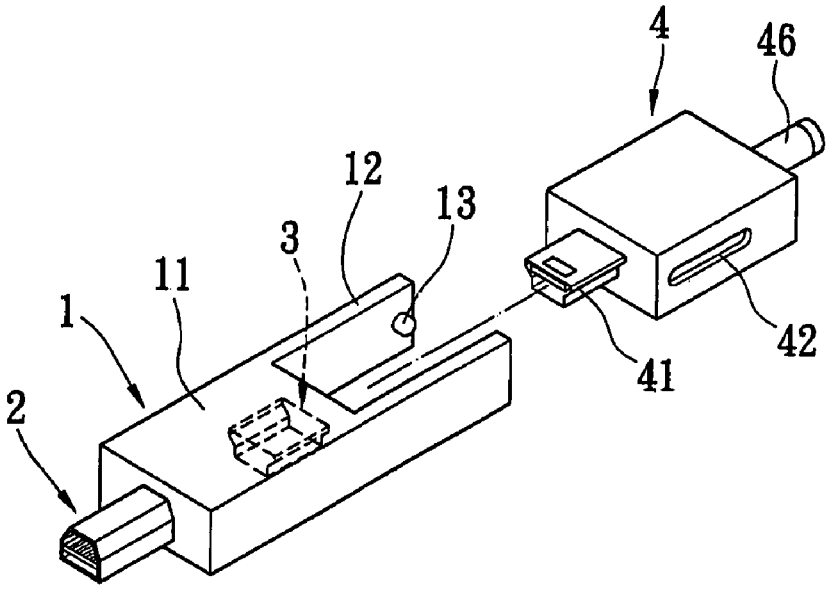
FIG. 6 is a third exploded perspective view of the transfer plug for a variety of sockets in accordance with the present invention.

In the present invention, the transfer plug further includes a signal plug 4, as shown in FIGS. 1-6, which is a first embodiment of the present invention. The signal plug 4 has a third connector 41 at a front end thereof. The third connector 41 can be a USB plug, the second connector 3 can be a USB socket engaging with the third connector 41. The third connector 41 also can be a Mini USB connector (as shown in FIG. 5 and FIG. 6). The signal plug 4 has a gliding groove 42 concavely on both lateral edges thereof. The first pivoted portions 13 shaped like a protruding pole are received in the corresponding gliding grooves 42, thereby the signal plug 4 engages with the insulating shell 1 and may move rear and forth along the insulating shell 1. The third connector 41 of the signal plug 4 may be inserted into the second connector 3 to achieve an electrical connection.

Please refer to FIG. 3 and FIG. 4. The signal plug 4 can have different structures. Each gliding groove 42 may further receive a movable gliding block 43 therein, which has a second pivoted portion 44 on a surface thereof to connect with the corresponding first pivoted portion 13. The first and the second pivoted portions 13, 44 have interchangeable structures, such as matched protruding poles and holes, etc. Accordingly, the above effects can be achieved via the gliding blocks 43 sliding rear and front in the gliding grooves 42.

Furthermore, each gliding groove 42 can further receive an elastic component 45 therein. Both ends of the elastic component 45 press against a side surface of the gliding block 43 and an inner wall of the gliding groove 42, respectively. Thereby the gliding block 43 elastically moves back and front and the third connector 41 elastically engages with the second connector 3. The elastic component 45 can be a spring or an elastic piece. The gliding block 43 and the elastic piece may be integrally formed by means of the gliding block 43 extending and bending to form the elastic piece from a side thereof.

Additionally, as shown in FIG. 5, the signal plug 4 can also have different structures. The signal plug 4 can further include a fourth connector 46 mounted on a rear end thereof. The specification and type of the fourth connector 46 has to be the same as that of the first connector 2, but is different from that of the second connector 41.

Figure 7:
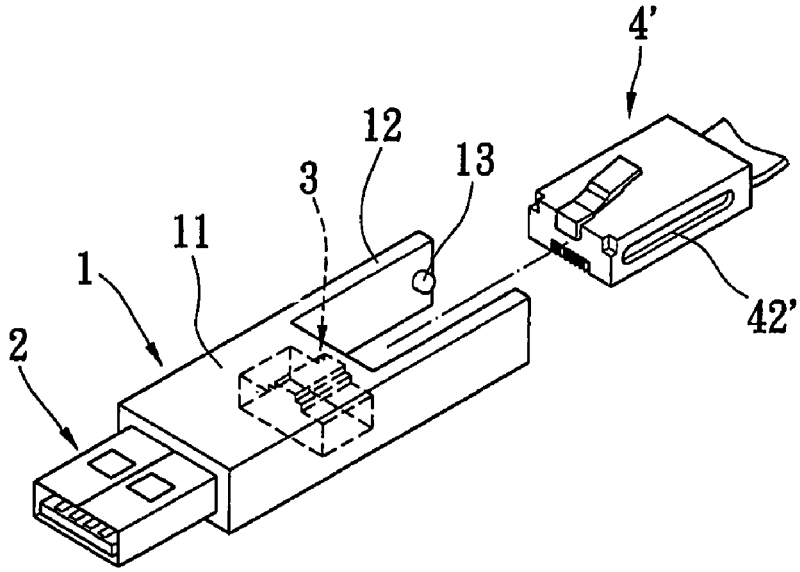
FIG. 7 is a fourth exploded perspective view of the transfer plug for a variety of sockets in accordance with the present invention.
Figure 8:
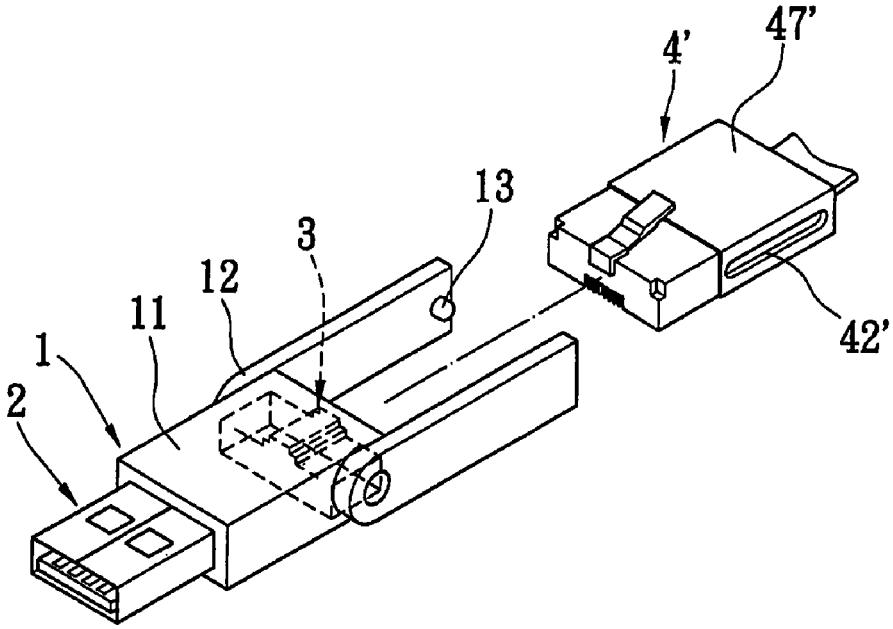
FIG. 8 is a fifth exploded perspective view of the transfer plug for a variety of sockets in accordance with the present invention.

Please refer to FIG. 7 and FIG. 8 showing a second embodiment of the signal plug 4' of the present invention. The difference between the second embodiment and the first embodiment is that the signal plug 4' is a RJ-45 plug (a plug for a network line). The second connector 3 is a socket connector engaging with the RJ-45 plug, and the signal plug 4' has gliding grooves 42' on two lateral edges thereof to achieve the above effects. The first connector 2 can be a USB connector, etc. Additionally, the signal plug 4' further include gliding blocks and elastic components (not shown) to achieve the above effects. As shown in FIG. 8, the signal plug 4' has a sealing component 47' at a rear end thereof via an injection molding method. The gliding grooves 42' is disposed in two lateral edges of the sealing component 47' and the gliding block 42' and the elastic component (not shown) may also be received in the gliding grooves 42', thereby achieving the above effects.

Figure 9:
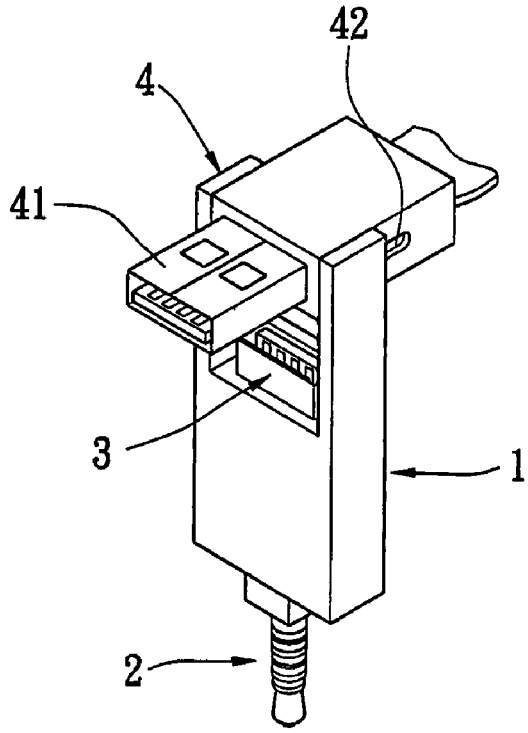
FIG. 9 is an assembled perspective view of the transfer plug for a variety of sockets in accordance with the present invention.
Figure 10:
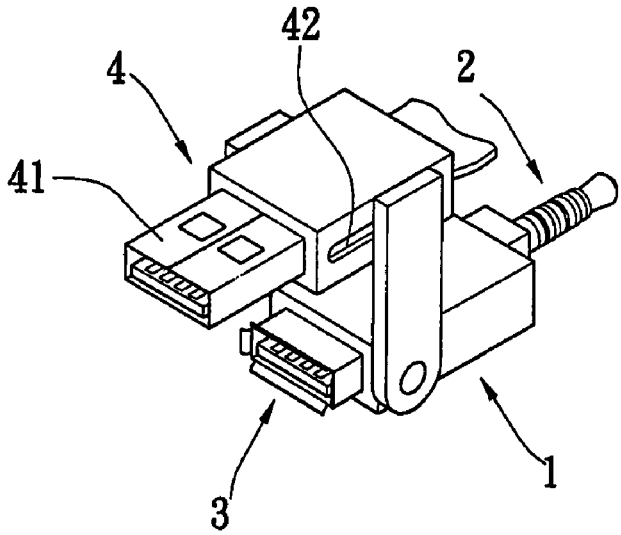
FIG. 10 is another assembled perspective view of the transfer plug for a variety of sockets in accordance with the present invention.

Please refer to FIG. 9 and FIG. 10. When the signal plug 4 of the present invention is assembled in the insulating shell 1, in an unused state, the signal plug 4 can move outwardly via the sliding movement between the first pivoted portions 13 and the gliding grooves 42, so that the third connector 41 departs from the second connector 3. The signal plug 4 can then slidably move between the two side arms 12 and turn in different directions via the first pivoted portions 13 so that the signal plug 4 can be used by itself and need not be disassembled for use, which is more convenient for actual use. Moreover, the side arms 12 can rotate to allow the signal plug 4 to move in more directions.

Figure 11:
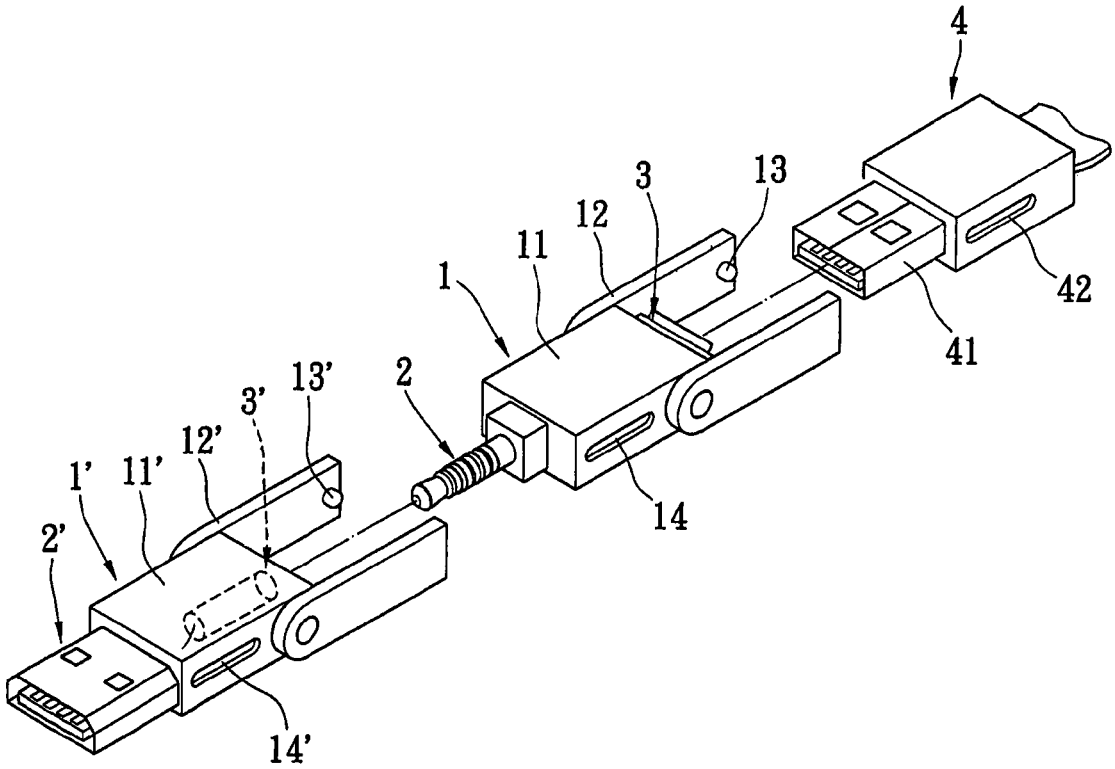
FIG. 11 is a perspective view of the transfer plug for a variety of sockets in accordance with the present invention, in a repeatedly connecting state.

As shown in FIG. 11, the body portion 11 of the insulating shell 1 of the present invention further has sliding grooves 14 concavely in the two lateral edges thereof. In this embodiment, the insulating shell 1 and the first and the second connectors 2, 3 form a first team of transiting plugs which can further connect to a corresponding second team of transiting plugs at a front end thereof. The second team of transiting plugs also includes an insulating shell 1', a first connector 2' and a second connector 3'. The insulating shell 1' also has a body portion 11', two side arms 12', and a first pin-jointed portion 13'. The body portion 11' also has sliding grooves 14'. The first pivoted portion 13' of the two arms 12' of the second team of transiting plugs is received in the sliding grooves 14' of the first team of transiting plugs, so that the insulating shell 1' of the second team of transiting plugs can movably engage with the insulating shell 1 of the first team of transiting plugs.

To further explain, the second connector 3' of the second team of transiting plugs is the connector which correspondingly engages with the first connector 2 of the first team of transiting plugs (such as an audio terminal or an audio terminal socket), and the first connector 2' of the second team of transiting plugs is another specification or type of connector (such as HDMI). Accordingly, the first team of transiting plugs of the present invention can be converted into another specification or type of connector via the second team of transiting plugs for engaging with different specifications and types of sockets. Following the above descriptions, users may further connect a second team of transiting plugs, a third team of transiting plugs, a fourth team of transiting plugs and so on, to the transfer plug, thereby the signal plug 4 of the present invention can be converted into a multitasking transfer plug for a variety of sockets by means of the above engagements.

Figure 12:
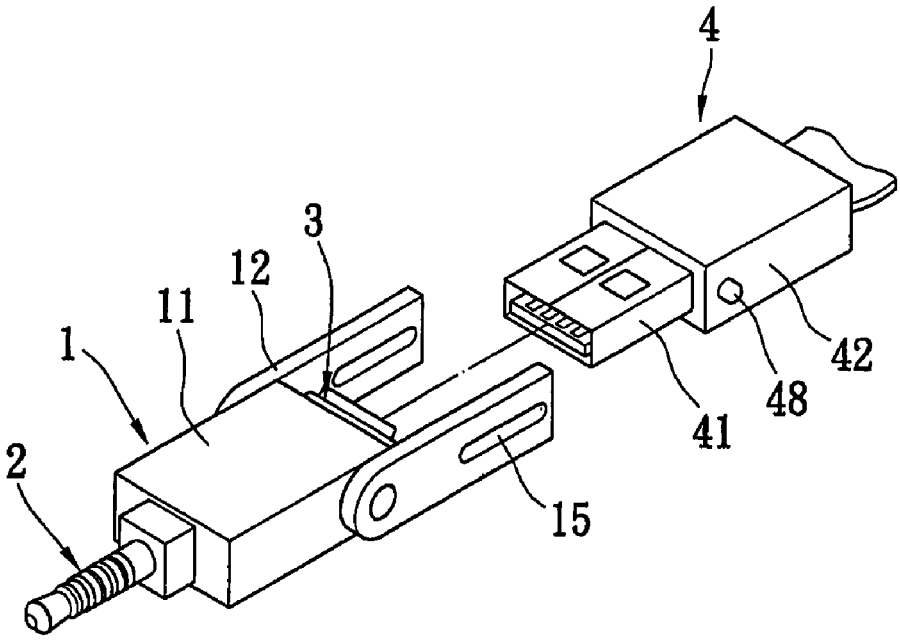
FIG. 12 is a sixth exploded perspective view of the transfer plug for a variety of sockets in accordance with the present invention.
Figure 13:
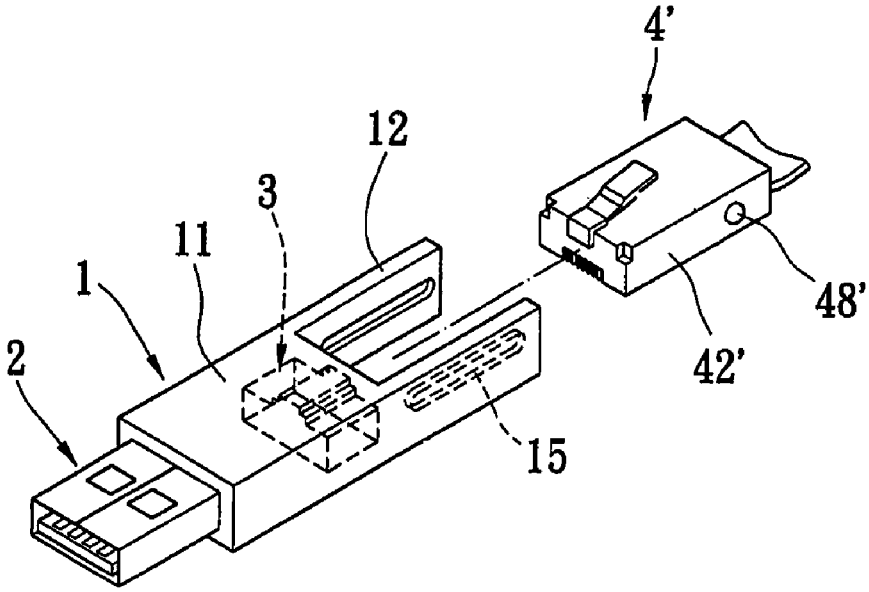
FIG. 13 is a seventh exploded perspective view of the transfer plug for a variety of sockets in accordance with the present invention.

Please refer to FIG. 12 and FIG. 13 showing the third embodiment of the present invention. The insulating shell 1 and the signal plugs 4, 4' have different structures from the above embodiments. The difference is that the insulating shell 1 further has another gliding groove 15 in each side arm 12 thereof and the signal plugs 4, 4' can further has another first pivoted portion 48 or 48' on each lateral edge thereof, respectively, which is a protruding pole, thereby the first pivoted portions 48, 48' of the signal plugs 4, 4', which are shaped as protruding poles, may slidably and rotatably engage with the gliding grooves 15 of the insulating shell 1 to accomplish the same purpose as described above. Of course, the gliding blocks the second pivoted portions and the elastic components (not shown) described in the above embodiments can be disposed in the gliding grooves 15 of the insulating shell 1 to achieve the same effects. Moreover, the gliding grooves 15 may be hollowed out and may penetrate through the two side arms 12 (as shown in FIG. 12), or be concave and defined in the two side arms 12 (as shown in FIG. 13), which can also achieve the effects described above.

Figure 14:
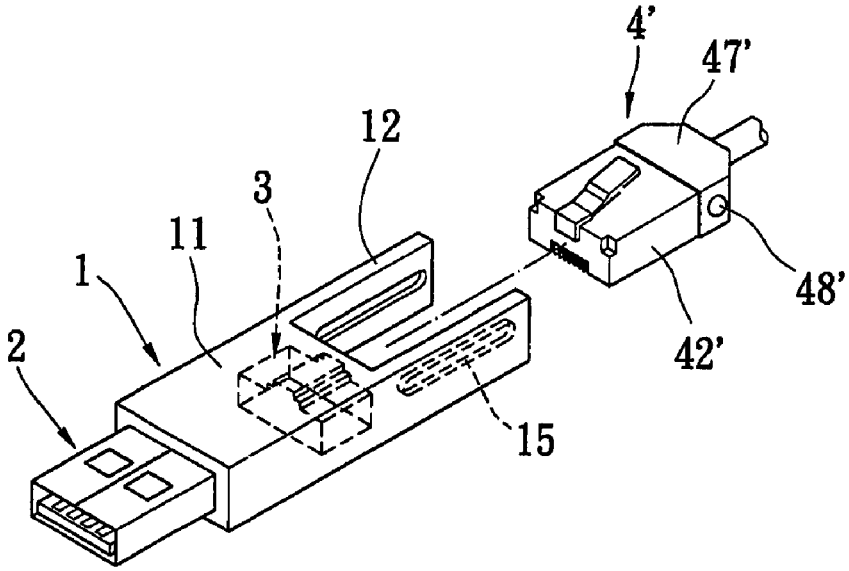
FIG. 14 is an eighth exploded perspective view of the transfer plug for a variety of sockets in accordance with the present invention.
Figure 15:
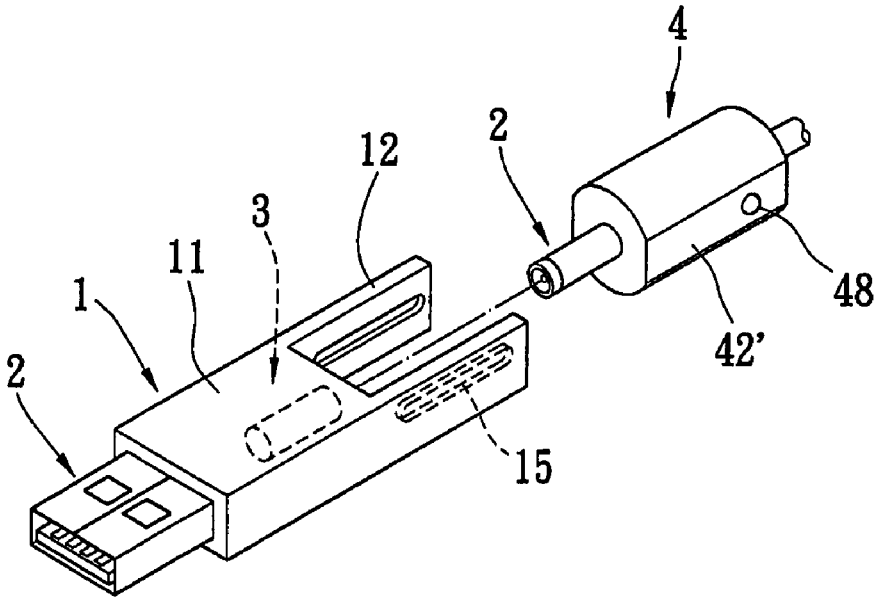
FIG. 15 is a ninth exploded perspective view of the transfer plug for a variety of sockets in accordance with the present invention.

Additionally, please refer to FIG. 14. The signal plug 4' has a sealing component 47' at the rear end thereof and the first pivoted portions 48' can be disposed on the two lateral edges of the sealing component 47', which can achieve the effects described above. The signal plug 4 may have a variety of appearances, such as that shown in FIG. 15 where the signal plug 4 is shaped like an elliptic column. The signal plug 4 can be designed with other appearances, which do not limit the present invention.

Figure 16:
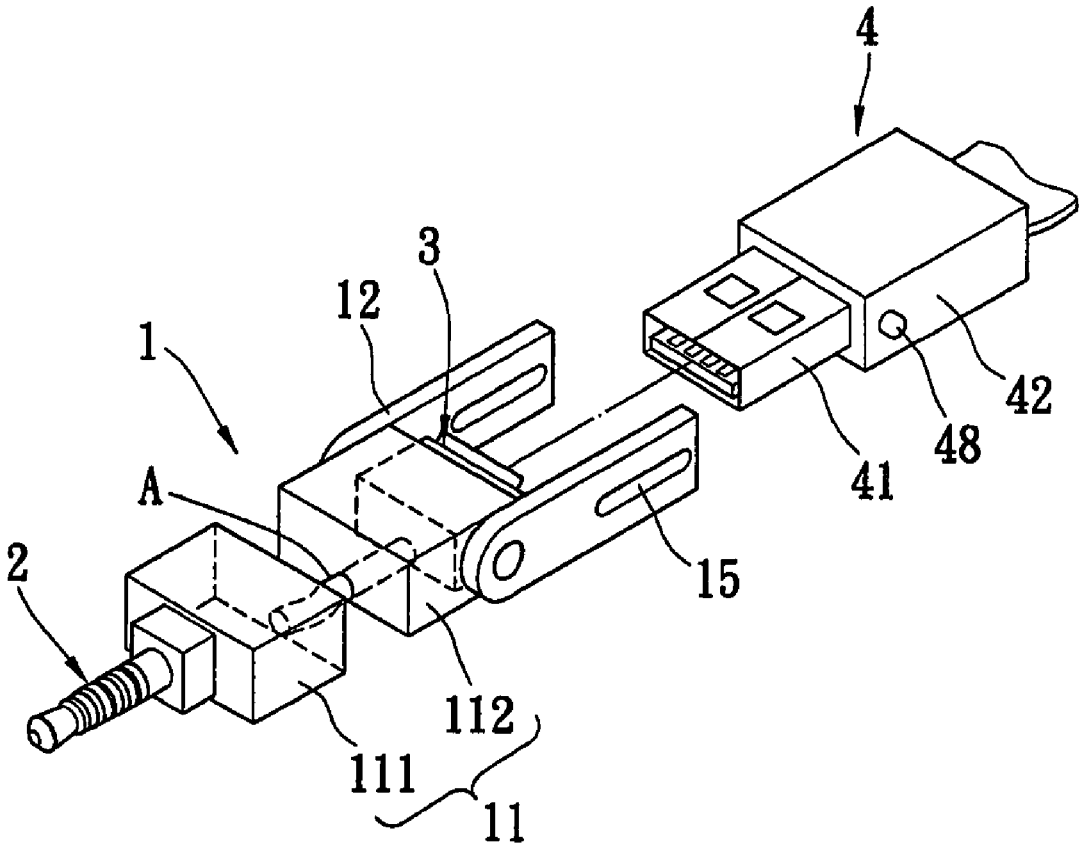
FIG. 16 is a tenth exploded perspective view of the transfer plug for a variety of sockets in accordance with the present invention.

Please refer to FIG. 16. The insulating shell 1 of the present invention can further have a different structure. The difference between this embodiment and the embodiments described above is that the body portion 11 further has a front body 111 and a rear body 112 which can separate from and engage with each other. The first connector 2 is mounted on the front body 111, the second connector 3 is mounted on the rear body 112 and the first and the second connectors 2, 3 electrically connect to each other via a transmission line A. The transmission line A can electrically connect to the first connector 2 via a pluggable structure. The two side arms 12 are combined with two lateral edges of the rear body 112. The front body 111 and the rear body 112 are connected with each other via a fastening connection and the like to achieve the object to separate from and engage with each other. Thereby users can easily replace different types of the first connectors 2 because the front body 111 and a rear body 112 can separate from and engage with each other and the transmission line A electrically connects to the first connector 2 via the pluggable structure. Additionally, users also can properly adjust the angle of the first connector 2 in a used state because the front body 111 and the rear body 112 can separate from each other.

Accordingly, the features and efficacy of the present invention can be summed up as follows:

1. The first and the second connectors are mounted on the insulating shell thereby the insulating shell has the function of a transiting plug. When the signal plug is connected to the insulating shell, the signal plug can electrically engage with the second connector. In an unused state, the signal plug can slidably move between the two side arms and turn in different directions via the sliding movement of the first pivoted portions and the gliding grooves, thereby the signal plug may be used by itself and does not need to be disassembled, which is convenient for actual use.

2. The gliding groove of the present invention further receives gliding blocks and elastic components therein so that the signal plug elastically engages with the second connector, thereby further providing convenience of use. Moreover, the transiting plugs of the present invention can be repeatedly connected to be converted into a multitasking transfer plug with different specifications and types of sockets and can have all kinds of changes for meeting actual demands.

3. The transiting plugs of the present invention can be repeatedly connected to be converted into a multitasking transfer plug with different specifications and types of sockets and can have all kinds of changes for meeting actual demands. The repeatedly connected transiting plugs can selectively select a transiting plug needed for a corresponding socket via the sliding grooves during using the plug, thereby avoiding disassembling the other transiting plugs.

What is disclosed above is only the preferred embodiments of the present invention and it is therefore not intended that the present invention be limited to the particular embodiments disclosed. It will be understood by those skilled in the art that various equivalent changes may be made depending on the specification and the drawings of the present invention without departing from the scope of the present invention.

The invention claimed is:

1. A transfer plug for a variety of sockets, comprising:

an insulating shell having a first connector and a second connector, the first connector combined with a front end of the insulating shell, the second connector combined with a rear end of the insulating shell and corresponding to the first connector, and the first connector and the second connector electrically connecting to each other;

two arms, each arm connected at one end to the insulating shell at one side and the other end extended rearwardly from the insulating shell;

a first pivoting portion disposed on each arm proximate to the other end; and a signal plug having a third connector engaged with the second connector at an front end thereof, and having a gliding groove concavely in a lateral edge thereof corresponded to the first pivoting portion, the signal plug movably connected to the insulating shell.

2. The transfer plug for a variety of sockets as claimed in claim 1, wherein the insulating shell has a sliding groove concavely in a lateral edge thereof.

3. The transfer plug for a variety of sockets as claimed in claim 1, wherein the first pivoting portion is a protruding pole correspondingly received in the gliding groove of the signal plug.

4. The transfer plug for a variety of sockets as claimed in claim 1, wherein the signal plug further has a fourth connector at a rear end thereof.

5. The transfer plug for a variety of sockets as claimed in claim 1, wherein the gliding groove further receives a movable gliding block, and the gliding block has a second pivoting portion correspondingly engaging with the first pivoting portion.

6. The transfer plug for a variety of sockets as claimed in claim 5, wherein an elastic component is further received in the gliding groove, and two ends of which press against a side of the gliding block and an inner wall of the gliding groove, respectively.

7. A transfer plug for a variety of sockets, comprising:

an insulating shell having a first connector and a second connector, the first connector combined with a front end of the insulating shell, the second connector combined with a rear end of the insulating shell and corresponding to the first connector, and the first connector and the second connector electrically connecting to each other;

two arms, each arm connected at one end to the insulating shell at one side and the other end extended rearwardly from the insulating shell;

a first pivoting portion disposed on the arms proximate to the other ends; and a signal plug, movably connecting to the insulating shell and having a gliding groove concavely in a lateral edge thereof corresponding to the first pivoted portion, the signal plug electrically engaging with the second connector.

8. The transfer plug for a variety of sockets as claimed in claim 7, wherein the insulating shell has a sliding groove concavely in a lateral edge thereof.

9. The transfer plug for a variety of sockets as claimed in claim 7, wherein the first pivoted portion is a protruding pole correspondingly received in the gliding groove of the signal plug.

10. The transfer plug for a variety of sockets as claimed in claim 7, wherein the signal plug is a RJ-45 plug and the second connector is a RJ-45 socket which connects with the signal plug.

11. The transfer plug for a variety of sockets as claimed in claim 7, wherein the gliding groove further receives a movable gliding block, and the gliding block has a second pivoted portion correspondingly engaging with the first pivoted portion.

12. The transfer plug for a variety of sockets as claimed in claim 11, wherein an elastic component is further received in the gliding groove, and two ends of which press against a side of the gliding block and an inner wall of the gliding groove, respectively.

13. A transfer plug for a variety of sockets, comprising:

an insulating shell having a first connector and a second connector, the first connector combined with a front end of the insulating shell, the second connector combined with a rear end of the insulating shell and corresponding to the first connector, and the first connector and the second connector electrically connecting to each other;

two arms, each arm connected at one end to the insulating shell at one side and the other end extended rearwardly from the insulating shell;

a gliding groove disposed on the arm proximate to the other end; and a signal plug, movably connecting to the insulating shell, having a first pivoted portion on a lateral edge thereof corresponding to the gliding groove, and the signal plug electrically engaging with the second connector.

14. The transfer plug for a variety of sockets as claimed in claim 13, wherein the insulating shell has a sliding groove concavely in a lateral edge thereof.

15. The transfer plug for a variety of sockets as claimed in claim 13, wherein a movable gliding block is further received in the gliding groove, and the gliding block has a second pivoted portion correspondingly engaging with the first pivoted portion.

16. The transfer plug for a variety of sockets as claimed in claim 15, wherein an elastic component is further received in the gliding groove, and two ends of which press against a side of the gliding block and an inner wall of the gliding groove, respectively.

17. The transfer plug for a variety of sockets as claimed in claim 13, wherein the signal plug has a third connector at a front end thereof connected to the second connector.

* * * * *